US006183407B1

(12) United States Patent
Hallgren et al.

(10) Patent No.: US 6,183,407 B1
(45) Date of Patent: Feb. 6, 2001

(54) CENTRIFUGAL SEPARATOR HAVING AXIALLY-EXTENDING, ANGLED SEPARATION DISCS

(75) Inventors: Ingvar Hallgren, Tumba; Thomas Davidsson, Stockholm; Leif Gunnar Larsson, Tumba; Hans Moberg, Stockholm, all of (SE)

(73) Assignee: Alfa Laval AB, Tumba (SE)

( * ) Notice: Under 35 U.S.C. 154(b), the term of this patent shall be extended for 0 days.

(21) Appl. No.: 09/322,686

(22) Filed: May 28, 1999

Related U.S. Application Data

(63) Continuation of application No. PCT/SE99/00515, filed on Mar. 30, 1999, and a continuation-in-part of application No. 09/241,914, filed on Feb. 2, 1999, now abandoned.

(30) Foreign Application Priority Data

Apr. 2, 1998 (SE) ..... 9801183

(51) Int. Cl.[7] ..... B04B 1/04; B04B 7/12

(52) U.S. Cl. ..... 494/49; 494/75

(58) Field of Search ..... 494/24, 36, 43, 494/49, 74, 75, 901; 210/168, 232, 360.1, 380.1, 416.5, 512.1; 184/6.24

(56) References Cited

U.S. PATENT DOCUMENTS

| | | | | |
|---|---|---|---|---|
| 648,664 | * | 5/1900 | Hoyt | 494/75 |
| 660,360 | * | 10/1900 | Burrell | 494/75 |
| 661,943 | * | 11/1900 | Arend | 494/75 |
| 663,111 | * | 12/1900 | Berrigan | 494/75 |
| 715,493 | * | 12/1902 | Lundstrom | 494/75 |
| 787,179 | * | 4/1905 | Hult et al. | 494/75 |
| 855,189 | * | 5/1907 | Ljungstrom | 494/75 |
| 869,808 | * | 10/1907 | Shee | 494/75 |
| 929,697 | * | 8/1909 | Ohlsson | 494/75 |
| 950,331 | * | 2/1910 | Hoyt | 494/75 |
| 969,399 | * | 9/1910 | Persoons . | |
| 1,208,960 | * | 12/1916 | Hedderich . | |
| 1,634,759 | * | 7/1927 | Sharples | 494/75 |
| 1,719,522 | | 7/1929 | Sharples . | |
| 2,067,273 | | 1/1937 | Knowles et al. . | |
| 2,138,467 | * | 11/1938 | Ayres et al. | 494/75 |
| 2,755,992 | | 7/1956 | Tait et al. . | |
| 3,858,793 | | 1/1975 | Dudrey . | |
| 4,106,689 | * | 8/1978 | Kozulla . | |
| 4,221,323 | * | 9/1980 | Courtot . | |
| 4,400,167 | * | 8/1983 | Beazley | 494/49 |

(List continued on next page.)

FOREIGN PATENT DOCUMENTS

| | | |
|---|---|---|
| 729169 | 5/1955 | (GB) . |
| 1089355 | 11/1967 | (GB) . |
| 1595816 | 8/1981 | (GB) . |
| WO 96/23589 | 8/1996 | (WO) . |

*Primary Examiner*—Charles E. Cooley
(74) *Attorney, Agent, or Firm*—Fish & Richardson P.C.

(57) ABSTRACT

In a rotor for a centrifugal separator there is delimited at one rotor end a distribution chamber (24) for a pressurized liquid supplied to the rotor for being cleaned from particles, and at the opposite rotor end there are liquid outlets arranged for reaction drive of the rotor. The liquid outlets open on the rotor outside in a liquid free space radially spaced from the rotational axis of the rotor. The separation chamber (7) of the rotor, which is situated between the distribution chamber (24) and the outlets (27), contains arcuate separation discs (11), which are distributed around the rotational axis (10) of the rotor and formed such that a lot of axially extending separation channels are delimited, which have a relatively small through-flow resistance to liquid to be cleaned. The separation channels extend axially from the distribution chamber (24) to a collecting chamber (25). The collecting chamber (2) communicates with an outlet chamber (26) at a radial level in the rotor corresponding to that of the radially innermost parts of the separation discs. Thus, efficient separation can be accomplished and the largest possible part of the pressure of the supplied liquid can be used for the rotation of the rotor.

12 Claims, 3 Drawing Sheets

U.S. PATENT DOCUMENTS 4,498,898 * 2/1985 Haggett ..... 494/24
4,615,315 * 10/1986 Graham .
4,787,975 * 11/1988 Purvey ..... 210/360.1
5,575,912 * 11/1996 Herman et al. .
5,637,217 6/1997 Herman et al. .
5,683,342 * 11/1997 McNair ..... 494/901
5,779,618 * 7/1998 Onodera et al. ..... 494/49

* cited by examiner

CENTRIFUGAL SEPARATOR HAVING AXIALLY-EXTENDING, ANGLED SEPARATION DISCS

CROSS-REFERENCE TO RELATED APPLICATIONS

This application claims the benefit of and is a continuation of PCT application PCT/SE99/00515, filed Mar. 30, 1999, which designates the United States of America, and also claims the benefit of and is a continuation-in-part of U.S. application Ser. No. 09/241,914, filed Feb. 2, 1999 , now abandoned. Both the PCT application and U.S. Ser. No. 09/241,914 claim the benefit of Swedish priority application No. 9801183-6, filed Apr. 2, 1998. The instant application also claims the benefit of said Swedish priority application.

FIELD OF THE INVENTION

The present invention relates to centrifugal separators intended for freeing a liquid from particles suspended therein and having a larger density than the liquid. More precisely the invention concerns a rotor for a centrifugal separator of this kind, which is rotatable around its center axis and includes a casing having two axially separated end walls and a surrounding wall situated therebetween and surrounding the center axis; an inlet member delimiting an inlet channel centrally in the casing; a separation means mounted in the casing; and at least one outlet member situated in the area of one of the end walls, spaced from the center axis and delimiting an outlet channel, which is directed in a way such that liquid flowing out therethrough accomplishes a reaction force on the rotor in its circumferential direction.

BACKGROUND OF THE INVENTION

Rotors of this kind, formed for reaction drive by means of an overpressure of the liquid to be cleaned, are previously known. As a rule they have been used for cleaning of relatively small liquid flows and have been relatively small and light.

In connections where rotors of this kind have been used the demands on separation efficiency have not been extremely large, but still certain means in the form of rotor inserts of different kinds have been suggested for improvement thereof.

Thus, inserts have been suggested in the form of filters of different kinds. GB 1 089 355 and GB 1 595 816 show examples of such filter inserts. Furthermore, different kinds of separation inserts have been suggested which are formed such that they shorten the sedimentation distance for particles, which are to be separated within the rotor from liquid supplied thereto. For instance, GB 729 169 shows a separation insert in the form of a helical wall, which delimits a helical flow path within the rotor for the liquid to be cleaned. U.S. Pat. No. 5,637,217 shows a separation insert having conical separation discs.

U.S. Pat. No. 2,067,273 shows a further construction of a centrifugal rotor of the initially defined kind. In this centrifugal rotor there is mounted a separation means including a lot of separation discs, which are arranged within the casing between the center axis and the surrounding wall of the casing and distributed around the center axis, so that they form a lot of axially extending separation channels. Each separation disc extends both axially and in a direction from the center axis towards the surrounding wall of the casing from a radially inner edge to a radially outer edge, forming an angle with imaginary radii extending from the center axis to the surrounding wall.

SUMMARY OF THE INVENTION

The object of the present invention is to provide a rotor of the initially defined kind, intended for reaction drive and provided with a particular separation means in the separation space of the rotor, which rotor can be given a better separation efficiency than previously known rotors of this kind.

This object can be achieved according to the invention if a rotor of the initially defined kind is provided with a separation means of the kind included in a centrifugal rotor according to U.S. Pat. No. 2,067,273 and, further, is provided with an inlet member delimiting an inlet channel centrally in the casing, which inlet channel communicates with the separation channels through a distribution chamber situated between a first one of the casing end walls and said separation means, said separation channels extending from the distribution chamber to an area close to the other end wall of the casing. A rotor of this kind is further characterized in

- that the separation discs leave a sludge space for accumulation of separated particles between their radially outer edges and the surrounding wall of the casing,
- that a partition is arranged between the separation discs and said other end wall of the casing in a way such that it delimits on its one side a collection chamber, in which the separation channels open, and on its other side delimits an outlet chamber,
- that the collection chamber communicates with the outlet chamber at a radial level in the rotor substantially corresponding to the radial level of the radially inner edges of the separation discs, and
- that the afore-mentioned outlet channel communicates with the outlet chamber and extends to the outside of the rotor, where it opens in a liquid free space at a radial level outside said level, at which the collection chamber and the outlet chamber communicate with each other.

In a rotor according to the invention it is possible to accomplish a relatively small through-flow resistance for the liquid to be cleaned, when this liquid passes through the rotor separation means, i.e. through said separation channels delimited between the separation discs. Compared with an ordinary filter or a set of conical separation discs a separation means of the kind suggested according to the invention and, per se, previously known in other kinds of centrifugal separators creates a surprisingly small through-flow resistance for the liquid to be cleaned, particularly if the liquid has a low viscosity. Despite a small through-flow resistance there can be achieved in the afore-mentioned separation channels a separation efficiency, which is as good as the one obtained in the spaces between conical separation discs. In connection with centrifugal separators of the kind here in question it is important that a part as large as possible of the overpressure of the liquid supplied to the rotor for being cleaned is utilized for the driving of the centrifugal rotor. By use of a separation means in the rotor of the kind suggested according to the invention a larger part of the overpressure of the liquid to be cleaned can be used for the driving of the centrifugal separator than by use of a technique according to, for instance, the afore-mentioned U.S. Pat. No. 5,637,217. This means that the centrifugal rotor according to the invention may be given a higher rotational speed and, thereby, a better separation efficiency than said previously known centrifugal rotor according to U.S. Pat. No. 5,637, 217.

Also in comparison with a centrifugal rotor according to the afore-mentioned U.S. Pat. No. 2,067,273, which contains a separation means similar to that of the centrifugal rotor according to the invention, the centrifugal rotor according to the invention may be given a better separation efficiency. This depends on the circumstance that the known centrifugal rotor has a less effective driving means than the centrifugal rotor according to the invention. Thus, the outlet nozzles for the reaction drive of the known centrifugal rotor are situated at a very small radius. Furthermore, the outlet channels of these nozzles open into liquid which is subjected to a certain overpressure.

That the overpressure, by which a liquid to be cleaned is supplied to a reaction driven centrifugal rotor, may be critical for the drive of the centrifugal rotor has been noticed for instance WO 96/23589. In this case the liquid in question is constituted by liquid flashed back from an automatically cleanable filter. In this connection it may be difficult sometimes to obtain a sufficiently high pressure of the returned liquid for achievement of a good operation of the reaction driven centrifugal rotor. In WO 96/23589 the problem has been resolved in a way such that the centrifugal rotor is continuously supplied not only with the returned liquid but also with a separate driving liquid. An arrangement of this kind is complicated and expensive and can often be avoided by use of the present invention, a good separation efficiency of the rotor being simultaneously maintained.

BRIEF DESCRIPTION OF THE DRAWINGS

The invention will be described more in detail in the following with reference to the accompanying drawing, in which FIG. 1 shows a section through the centrifugal rotor, taken along a line I—I in FIG. 2, and FIG. 2 shows the centrifugal rotor in FIG. 1 seen from above, only half of a casing surrounding the centrifugal rotor being shown. The FIGS. 3–5 show a second embodiment of the centrifugal rotor according to the invention. Thus.

DETAILED DESCRIPTION

Figure 1:
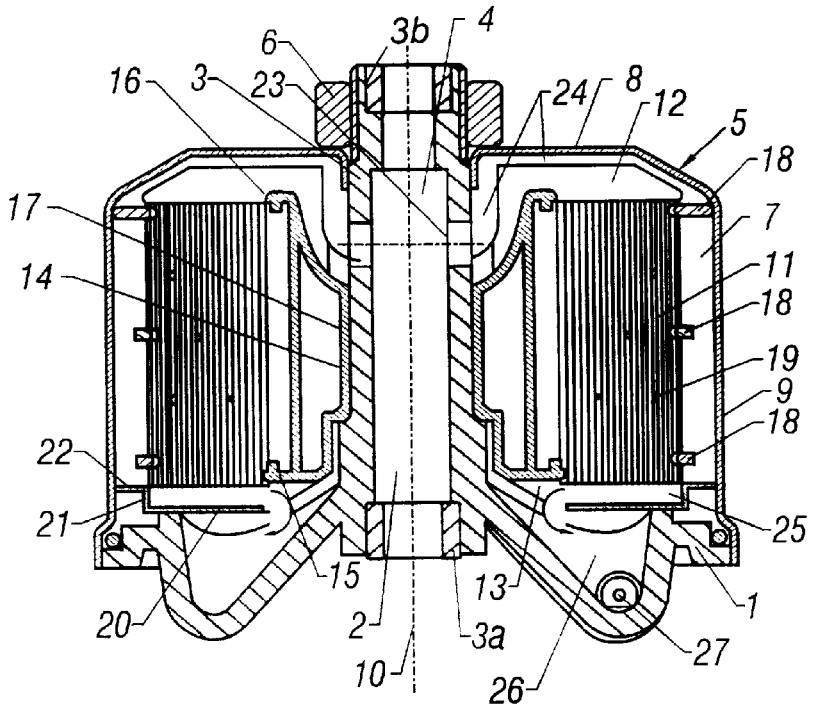
FIGS. 1 and 2 show a first embodiment of the centrifugal rotor according to the invention. Thus.
Figure 2:
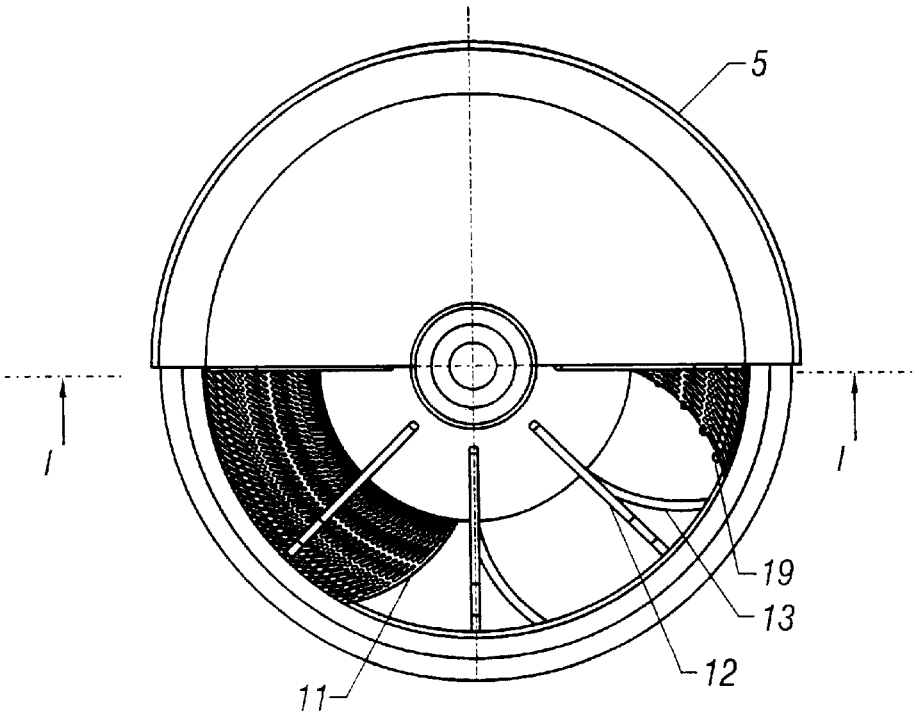

The rotor in FIGS. 1 and 2 includes a circular base plate 1, which has a central opening 2 and centrally supports a tubular column 3. The interior of the column 3 forms a channel 4, which communicates with the central opening 2 of the base plate.

An annular cap 5 is placed around the column 3 and is kept fastened thereto and to the base plate 1 by means of a nut 6. The cap 5 and the base plate 1 form a casing around a separation chamber 7 in the rotor. In this casing the base plate 1 forms a first end wall, whereas the cap 5 forms a second end wall 8 and a surrounding wall 9. The surrounding wall 9 extends between the end walls 1 and 8 concentrically around the tubular column 3.

The rotor is rotatable around a center axis 10 and for this purpose the central column 3 supports bearing members 3*a* and 3*b* at its respective ends.

Within the separation chamber 7 the rotor has a separation means comprising a large number of separation discs 11 evenly distributed around the rotor center axis 10. Each one of the separation discs extends both arcuately in a direction from the center axis 10 towards the surrounding wall 9, as can be seen from FIG. 2, and axially between flow distributing and liquid entraining upper radial wings 12 and lower arcuately extending wings 13, as can be seen from FIG. 1. The separation discs 11 form between themselves thin separation channels, which have the same extension as the separation discs. In FIG. 2 part of the separation discs have been left out so that some of the lower arcuately extending wings 13 can be seen.

The separation discs 11 are supported, like the wings 12 and 13, by a central supporter comprising a sleeve 14, which surrounds and is guided by the central column 3. The sleeve 14 is formed in one piece with a lower annular supporting member 15, which extends by an axially upwardly directed annular fastening flange into recesses intended therefor in the lower edge portions of the separation discs 11. Correspondingly formed recesses in the upper edge portions of the separation discs form an annular upwardly open groove 30 (see FIG. 4) for an axially downwardly directed annular fastening flange of an upper annular supporting member 16.

The supporting members 15 and 16 can be axially separated from each other and from the separation discs 11 by the sleeve 4 being divided at 17 (FIG. 1).

The radially outer parts of the separation discs 11 are kept in place relative to each other by means of three rings 18, which at different axial levels surround all of the separation discs. For reasons evident from the following the uppermost of these rings 18 fills the whole interspace between the separation discs 11 and the surrounding wall 9 of the casing. The separation discs 11 are kept at a certain distance from each other by means of spacing members 19 formed in one piece with the separation discs and distributed across their surfaces in some suitable manner.

Between the lower wings 13 and the base plate 1 an annular partition is adapted to extend from the surrounding wall 9 of the casing radially inwardly to the area of the radially innermost parts of the separation discs 11. The partition has a central plane portion 20 situated axially opposite to the separation discs 11; a short cylindrical intermediate portion 21 surrounding the wings 13; and radially outermost a further plane portion 22, which fills the interspace between the surrounding wall 9 of the casing and the radially outer lowermost parts of the separation discs 11.

A liquid to be cleaned in the rotor is to enter by an overpressure into the channel 4 through the opening 2 in the base plate 1. Alternatively, the liquid may enter the channel 4 from the opposite direction. From the channel 4 liquid is to be conducted through openings 23 in the column 3 into a distribution chamber 24, which is formed in the upper part of the casing 5 and in which the upper radial wings 12 are situated.

Then the liquid shall flow axially through the separation channels formed between the separation discs 11. Therein particles suspended in the liquid and being heavier than the liquid are to be separated, and liquid is to flow furtheron downwards to a collecting chamber 25, in which the arcuately extending lower wings 13 are situated. As can be seen from FIG. 2, the wings 13 have an arcuate extension opposite to that of the separation discs 11. Thereby, the wings 13 may give axial support to a larger number of separation discs than if they extended only radially and, still, function as members for rotational entrainment of liquid situated in the collecting chamber 25. The uppermost ring 18 prevents an axial liquid flow radially outside the separation discs 11.

The base plate 1 is provided with two depressions, which form two outlet chambers 26 below the partition portion 20.

These outlet chambers 26 communicate with the aforementioned collecting chamber 25 at the radially inner edge of the partition portion 20.

At a limiting wall in each of the outlet chambers 26, facing in the circumferential direction of the rotor, the base plate 1 is provided with a nozzle having an outlet channel 27. The outlet channel 27 opens in a liquid free space, which is at atmospheric pressure, outside the rotor at a level radially outside the inner edge of the partition portion 20. When the pressurised liquid leaves the outlet chambers 26 through the outlet channels 27 the rotor is actuated by a reaction force bringing the rotor into rotation around the center axis 10.

How the rotor is supported and is journalled and how liquid to be cleaned is introduced into the channel 4 has not been shown or described since this is well known to the skilled person of the relevant art.

The separation discs 11 as well as the members 14–16 keeping them in place in the rotor may, preferably, be made of plastics. If desired, the separation discs may be formed in a way such that they extend through substantially the whole of the separation chamber of the rotor. An advantage with separation discs of the kind described here, in comparison with conical separation discs, is that all of the discs may be formed identically alike and, in spite of this, be given a form such that they extend in all desired parts of the separation chamber. A package of such separation discs, thus, is not bound to a certain geometrical shape in the same way as is a stack of identically formed conical separation discs, but may be adapted to a desired shape of the rotor. Therefore, an available space within the rotor may be utilized to its maximum for the centrifugal separation in question.

In a centrifugal rotor formed in accordance with FIGS. 1 and 2 particles heavier than the liquid are to be separated therefrom in the separation channels and will then slide along the separation discs towards and be collected in a sludge space at the surrounding wall 9 of the rotor. After a certain time of operation or when a certain amount of particles have been collected in the rotor, the operation is to be interrupted and the cap 5 dismounted for removal of the particles.

Within the scope of the invention it is possible to provide a rotor of the kind here described with an insert, which collects separated particles and which can be removed from the rotor during an interruption of the operation and be disposed of together with the particles, whereafter a new insert of this kind can be mounted in the rotor.

An insert of this kind could comprise the above described partition 20–22 and a cylindrical container formed in one piece therewith and adapted to form a removable liner within the described cap 5. A liner of this kind could extend from the partition 20–22 up to the uppermost ring 18 surrounding the separation discs.

Alternatively, if the separation discs 11 and their supporting members 14–16 could be made sufficiently inexpensive, even these members together with the partition 20–22 and a liner of the just described kind could form an exchangeable insert. An exchangeable insert of this kind would not necessarily have to be thrown away but could, instead, be cleaned and reused.

Figure 3:
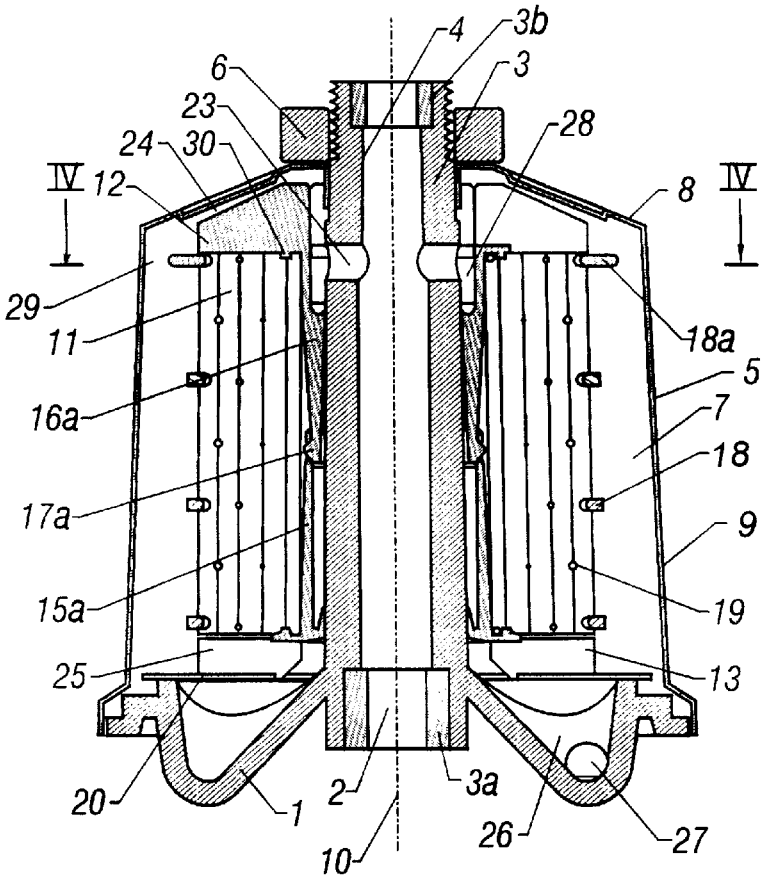
FIG. 3 shows a section similar to that of FIG. 1.
Figure 4:
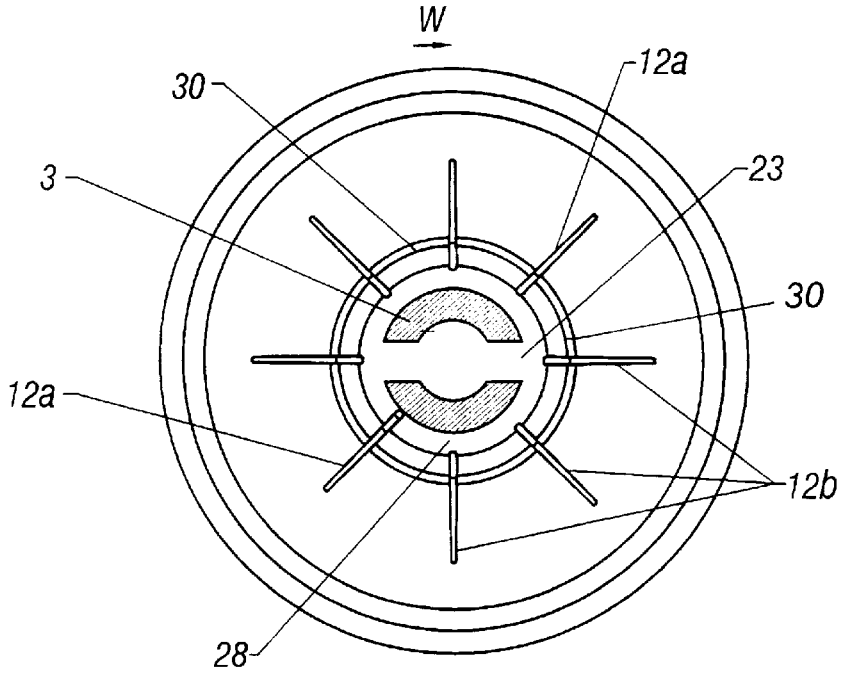
FIG. 4 is a mixture of a view and a section along the line IV—IV in FIG. 3 and shows the radial extension of certain wings in the upper part of the centrifugal rotor.
Figure 5:
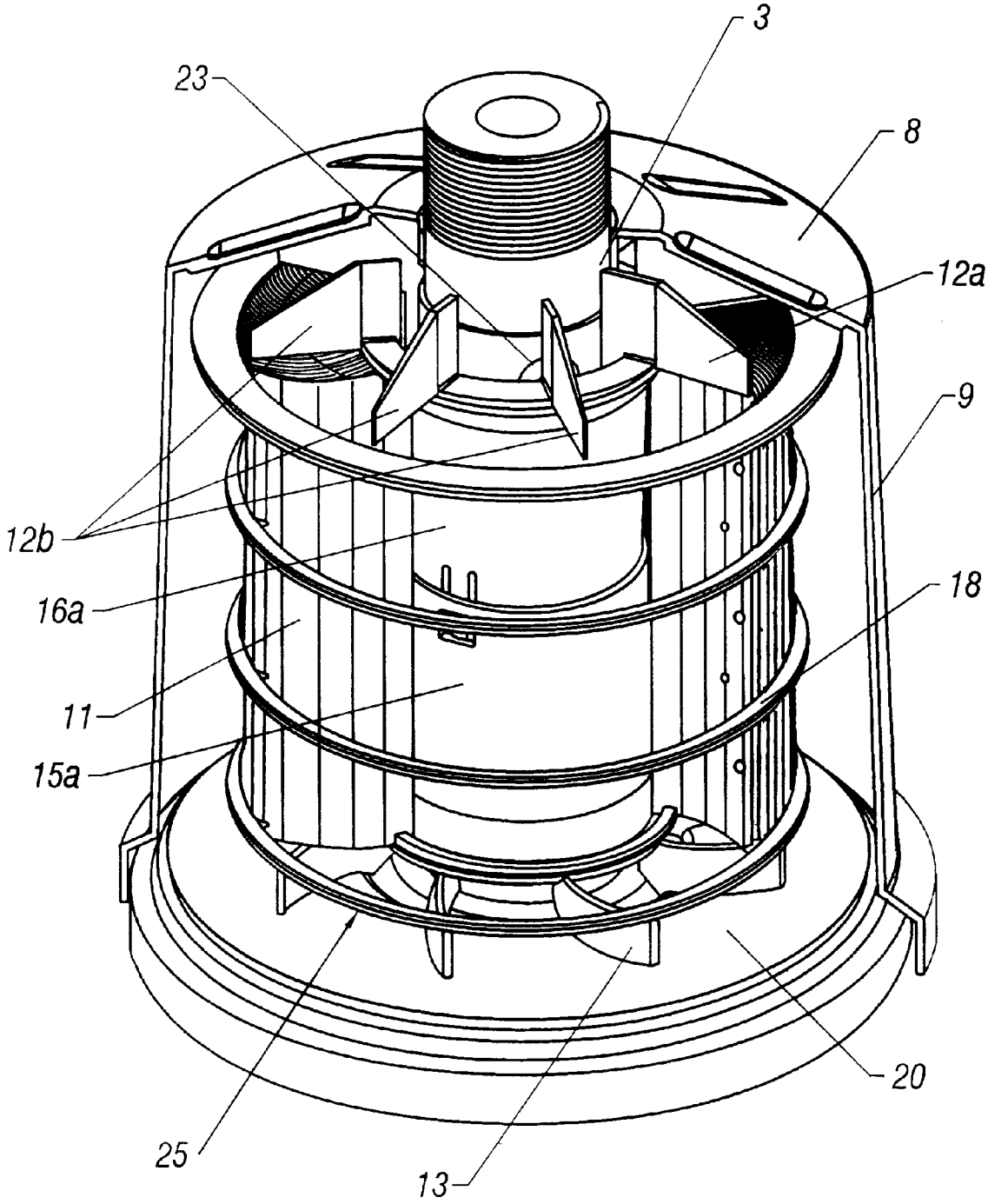
FIG. 5 illustrates parts of the centrifugal rotor, part of its surrounding casing being removed.

FIGS. 3–5 show a somewhat modified centrifugal rotor according to the invention. The same reference numerals have been used in the FIGS. 3–5 as in FIGS. 1 and 2 for corresponding details.

In the rotor shown in FIGS. 3–5 the separation discs 11 are mounted in a supporter comprising a lower supporting member 15*a* and an upper supporting member 16*a*. The supporting members 15*a* and 16*a* are removably connected with each other by means of a snap lock device 17*a* and are guided by the central column 3. The snap lock device 17*a* is placed radially inside the separation discs 11 about half-way between their axial ends, whereby it is relatively difficult to reach and, thus, cannot be opened unintentionally. Thereby, the separation discs cannot be freed unintentionally from the supporting members 15*a* and 16*a*.

The lower supporting member 15*a* is formed in one piece with the partition 20 and with the wings 13 in the collecting chamber 25. The upper supporting member 16*a* is formed in one piece with the wings 12 in the distribution chamber 24.

As can be seen from the FIGS. 4 and 5, the wings 12 are of two different kinds. Two wings 12*a,* which are situated diametrically on opposite sides of the column 3, extend substantially all the way into the column 3 in the plane wherein the inlet openings 23 of the column 3 are situated. The other wings 12*b* do not extend, in this plane, into the column 3 but leave between themselves and the column 3 free spaces 28.

The column 3 has two inlet openings 23 for liquid to be treated in the rotor. Each one of these openings opens in an area situated immediately in front of one of the wings 12*a* extending all the way into the column 3, seen in the rotational direction of the rotor. This rotational direction is shown by an arrow w in FIG. 4. Thus, liquid entering the rotor through an opening 23 will be entrained in the rotor rotation by the adjacent wing 12*a* and, thus, be prevented from sliding relative to the rotor in a direction opposite to its rotational direction. The main part of the liquid supplied by an overpressure through an inlet opening 23 will be forced in the rotational direction of the rotor through a passage that is formed closest to the column 3 by inter alia said spaces 28, up to the other wing 12*a* extending all the way in to the column 3. Hereby, an even distribution is achieved of incoming liquid into all the interspaces between the wings 12*a* and 12*b* and, thereby, in all of the separation channels between the separation discs 11.

The described arrangement of different kinds of wings 12*a* and 12*b,* respectively, and the particular location of the inlet openings 23 in relation to the wings is an advantageous alternative to having a large number of relatively small inlet openings in the column 3, e.g. one inlet opening in each interspace between adjacent wings, for accomplishment of an even distribution of liquid in the rotor separation chamber. The above described arrangement may be used as soon as the number of wings 12 exceeds the number of inlet openings 23.

In the rotor according to the FIGS. 3–5 the uppermost ring 18*a,* which surrounds the separation discs, does not extend all the way out to the casing 5 but leaves a small space 29 between itself and the casing. This space is dimensioned such that it allows passage of solids, which are separated from the incoming liquid already in the distribution chamber 24 and, thus, deposit on the inside of the casing 5 already in the area of the ring 18*a*. After a short time of rotor operation a layer of particles having deposited on the inside of the casing will at least partly fill the space 29. As long as no layer of particles of the same thickness has been formed on the inside of the casing 5 below the ring 18*a,* separated particles will move slowly downwardly, however, along the casing 5 passing the ring 18*a,* whereby accumulation of particles in the distribution chamber 24 is avoided.

As can be seen, the casing 5 is also slightly conical, so that its diameter increases in the axial direction away from the distribution chamber 24, which contributes to avoiding complete clogging of the space 29.

What is claimed is:

1. A rotor for a centrifugal separator for freeing a liquid from particles suspended therein and having a density larger than that of the liquid, the rotor being rotatable around its center axis (10) and comprising a casing including two axially separated end walls (1, 8) and a surrounding wall (9) situated therebetween and surrounding the center axis (10), a separation means mounted in the casing and comprising a plurality of separation discs (11), said discs being arranged in the casing between the center axis (10) and the surrounding wall (9) of the casing and being distributed around the center axis (10), to form a plurality of axially extending separation channels, each said separation disc (11) extending both axially and in a direction from the center axis (10) towards the surrounding wall (9) of the casing from a radially innermost part to a radially outermost part of the separation disc, forming an angle with imaginary radii extending from the center axis (10) to the surrounding wall (9), an inlet member (3) delimiting an inlet channel (4) centrally in the casing, said inlet channel (4) communicating with the separation channels through a distribution chamber (24) situated between a first (8) of the end walls of the casing and said separation means, the separation channels extending from the distribution chamber (24) to an area in the vicinity of the other end wall (1) of the casing, and at least one outlet member delimiting an outlet channel (27), which is directed in a way such that liquid flowing out therethrough accomplishes a reaction force on the rotor in its circumferential direction and causes the rotor to rotate in a predetermined rotational direction, wherein the separation discs (11) leave a sludge space for accumulation of separated particles between the radially outer edges of the separation discs and the surrounding wall (9) of the casing, wherein a partition (20–22) is arranged between the separation discs (11) and said other end wall (1) of the casing such that on one side the partition delimits a collecting chamber (25), in which the separation channels open, and on the other side the partition delimits an outlet chamber (26), said partition carrying entrainment members (13) on said one side that delimits the collecting chamber (25), said entrainment members (13) supporting the separation discs (11) and being elongated and forming an angle with the separation discs (11) seen in a plane perpendicular to the rotor center axis, wherein the collecting chamber (25) communicates with the outlet chamber (26) at a radial level in the rotor substantially corresponding to the radial level of the radially innermost parts of the separation discs, and wherein the outlet channel (27) communicates with the outlet chamber (26) and extends to the outside of the rotor, where the outlet channel opens in a liquid free space at a radial level outside said level, at which the collecting chamber (25) and the outlet chamber (26) communicate with each other.

2. A rotor according to claim 1, in which every separation disc (11) extends arcuately in a direction from the center axis (10) towards the surrounding wall (9).

3. A rotor according to claim 1, in which the distribution chamber (24) contains distribution members, said distribution members being adapted for entrainment in the rotor rotation of liquid flowing from the inlet channel (4) to the separation channels, and being elongated in shape, and forming an angle with the separation discs (11), seen in a plane perpendicular to the rotor center axis (10).

4. A rotor according to claim 3, in which said distribution members are situated partly radially inside the separation discs (11).

5. A rotor according to claim 3, in which the inlet channel (4) opens into the rotor radially inside the separation discs (11) between the axially separated ends thereof.

6. A rotor according to claim 1, in which the separation discs (11) are surrounded by at least one retaining ring.

7. A rotor according to claim 1, in which a flow impeding or preventing member (18) is arranged between the separation discs (11) and the surrounding wall (9) of the casing in an area between the distribution chamber (24) and said sludge space.

8. A rotor for a centrifugal separator for freeing a liquid from particles suspended therein and having a density larger than that of the liquid, the rotor being rotatable around its center axis (10) and comprising a casing including two axially separated end walls (1, 8) and a surrounding wall (9) situated therebetween and surrounding the center axis (10), a separation means mounted in the casing and comprising a plurality of separation discs (11), said discs being arranged in the casing between the center axis (10) and the surrounding wall (9) of the casing and being distributed around the center axis (10), to form a plurality of axially extending separation channels, each said separation disc (11) extending both axially and in a direction from the center axis (10) towards the surrounding wall (9) of the casing from a radially innermost part to a radially outermost part of the separation disc, forming an angle with imaginary radii extending from the center axis (10) to the surrounding wall (9), an inlet member (3) delimiting an inlet channel (4) centrally in the casing, said inlet channel (4) communicating with the separation channels through a distribution chamber (24) situated between a first (8) of the end walls of the casing and said separation means, the separation channels extending from the distribution chamber (24) to an area in the vicinity of the other end wall (i) of the casing, and at least one outlet member delimiting an outlet channel (27), which is directed in a way such that liquid flowing out therethrough accomplishes a reaction force on the rotor in a circumferential direction of the rotor and causes the rotor to rotate in a predetermined rotational direction, wherein the separation discs (11) leave a sludge space for accumulation of separated particles between the radially outer edges of the discs and the surrounding wall (9) of the casing, wherein a partition (20–22) is arranged between the separation discs (11) and said other end wall (1) of the casing such that on one side the partition delimits a collecting chamber (25), in which the separation channels open, and on the other side the partition delimits an outlet chamber (26), wherein the collecting chamber (25) communicates with the outlet chamber (26) at a radial level in the rotor substantially corresponding to the radial level of the radially innermost parts of the separation discs, and wherein the outlet channel (27) communicates with the outlet chamber (26) and extends to the outside of the rotor, where the outlet channel opens in a liquid free space at a radial level outside said level, at which the collecting chamber (25) and the outlet chamber (26) communicate with each other, in which the separation discs (11) are mounted between two supporting members (15, 16; 15*a*, 16*a*), and said supporting members engage releasingly with the separation discs (11) at the axially separated ends thereof and are connected with each other radially inside the separation discs.

9. A rotor according to claim 8, in which the supporting members (15*a*, 16*a*) are connected with each other by a snap lock device (17*a*).

10. A rotor according to claim 8, in which the separation discs (11) have edges directed towards the respective end walls (1, 8) of the casing said edges having recesses, said recesses together forming annular grooves extending around the rotor center axis (10), said supporting members (15, 16; 15*a*, 16*a*) extending into said grooves for retainment of the separation discs (11).

11. A rotor according to claim 8, in which said supporting members (15, 16; 15*a*, 16*a*) surround and are guided by a column (3) extending axially in the casing (50).

12. A rotor for a centrifugal separator for freeing a liquid from particles suspended therein and having a density larger than that of the liquid, the rotor being rotatable around its center axis (10) and comprising a casing including two axially separated end walls (1, 8) and a surrounding wall (9) situated therebetween and surrounding the center axis (10), a separation means mounted in the casing and comprising a plurality of separation discs (11), said discs being arranged in the casing between the center axis (10) and the surrounding wall (9) of the casing and being distributed around the center axis (10), to form a plurality of axially extending separation channels, each said separation disc (11) extending both axially and in a direction from the center axis (10) towards the surrounding wall (9) of the casing from a radially innermost part to a radially outermost part of the separation disc, forming an angle with imaginary radii extending from the center axis (10) to the surrounding wall (9), an inlet member (3) delimiting an inlet channel (4) centrally in the casing, said inlet channel (4) communicating with the separation channels through a distribution chamber (24) situated between a first (8) of the end walls of the casing and said separation means, the separation channels extending from the distribution chamber (24) to an area in the vicinity of the other end wall (1) of the casing, and at least one outlet member delimiting an outlet channel (27), which is directed in a way such that liquid flowing out therethrough accomplishes a reaction force on the rotor in a circumferential direction of the rotor and causes the rotor to rotate in a predetermined rotational direction, wherein the separation discs (11) leave a sludge space for accumulation of separated particles between the radially outer edges of the discs and the surrounding wall (9) of the casing, wherein a partition (20–22) is arranged between the separation discs (11) and said other end wall (1) of the casing such that on one side the partition delimits a collecting chamber (25), in which the separation channels open, and on the other side the partition delimits an outlet chamber (26), wherein the collecting chamber (25) communicates with the outlet chamber (26) at a radial level in the rotor substantially corresponding to the radial level of the radially innermost parts of the separation discs, and wherein the outlet channel (27) communicates with the outlet chamber (26) and extends to the outside of the rotor, where the outlet channel opens in a liquid free space at a radial level outside said level, at which the collecting chamber (25) and the outlet chamber (26) communicate with each other, in which said central inlet channel (4) communicates with the distribution chamber (24) through a number of inlet openings (23) in the inlet member (3), the distribution chamber (24) contains a number of wings (12) evenly distributed around the inlet member (3) and extending in a direction therefrom through the distribution chamber towards said casing, the number of wings being larger than the number of inlet openings (23), some wings (12*a*), corresponding to the number of inlet openings (23), extend substantially all the way into the inlet member (3) in the area of the inlet openings (23), whereas the remaining wings (12*b*) leave a space (28) between said remaining wings and the inlet member (3) in said area, and each inlet opening (23), seen in the rotational direction of the rotor, is situated in front of a wing (12*a*) of the kind extending all the way into the inlet member (3) and behind at least one wing (12*b*) of said remaining wings.

* * * * *